United States Patent [19]

Fairgrieve

[11] Patent Number: 4,655,359

[45] Date of Patent: Apr. 7, 1987

[54] PRESSURE TANK CONSTRUCTION FOR CORROSIVE MEDIUM

[75] Inventor: Donald F. Fairgrieve, Islington, Canada

[73] Assignee: Airclean Engineering Products, Islington, Canada

[21] Appl. No.: 863,302

[22] Filed: May 15, 1986

[51] Int. Cl.[4] ..... B65D 7/02

[52] U.S. Cl. ..... 220/67; 220/3; 220/5 A

[58] Field of Search ..... 220/67, 1 B, 3, 5 R, 220/5 A, 66, 69, 70, 901

[56] References Cited

U.S. PATENT DOCUMENTS

| | | | |
|---|---|---|---|
| 2,092,490 | 9/1937 | Zerbe | 220/3 X |
| 2,758,367 | 8/1956 | Dougherty | 220/5 A |
| 2,962,182 | 11/1960 | Rossheim | 220/3 |
| 2,993,617 | 7/1961 | Briggs | 220/69 X |
| 3,073,475 | 1/1963 | Fingerhut | 220/3 |
| 3,152,718 | 10/1964 | Weatherhead, Jr. | 220/3 X |
| 3,199,712 | 8/1965 | Nurkiewicz | 220/3 |
| 3,497,100 | 2/1970 | Sagara et al. | 220/3 |
| 3,952,904 | 4/1976 | Verlinden | 220/5 R |

*Primary Examiner*—Steven M. Pollard
*Attorney, Agent, or Firm*—Sim & McBurney

[57] ABSTRACT

A steel hot water tank having a corrosion inhibiting coating on the interior surfaces of the tank is provided with end portions each having concave interior surfaces. A connecting device is used to permit connection of a precoated tank end to a precoated tank interior whereby the heat of welding the tank end to the tank side wall does not degrade the corrosion inhibiting coating of the tank interior. This construction provides increased volume for the tank compared to existing hot water tank constructions, and enables the use of material thicknesses in the tank ends which may be equal to or less than the material thicknesses of the tank side wall. A process is provided which permits the welding of the tank end to the tank side wall without degrading the corrosion inhibiting coatings previously applied to the parts being assembled.

21 Claims, 10 Drawing Figures

FIG. 1.
PRIOR ART
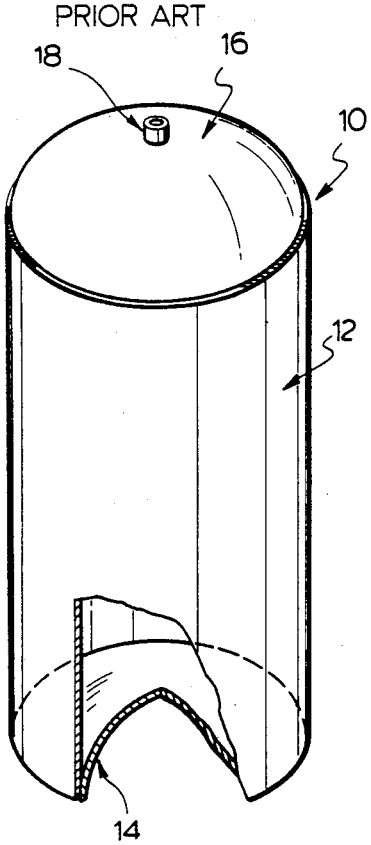
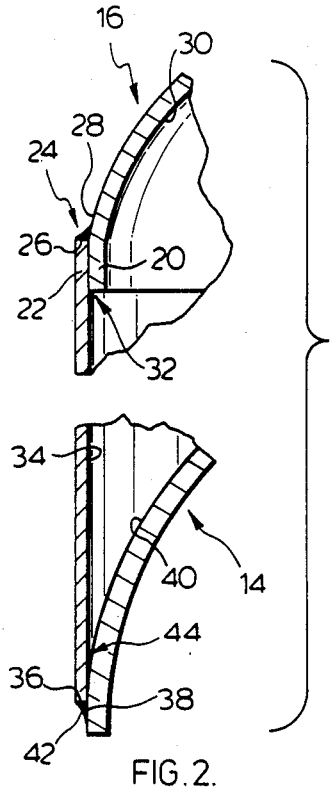
FIG. 2.
PRIOR ART
FIG. 3.
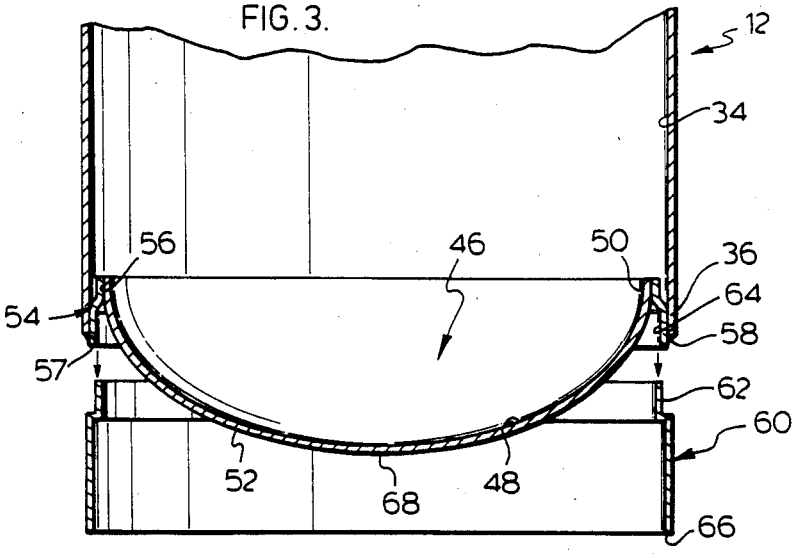

PRESSURE TANK CONSTRUCTION FOR CORROSIVE MEDIUM

FIELD OF THE INVENTION

This invention relates to improvements in hot water steel tanks having corrosion inhibiting coatings on interior surfaces.

BACKGROUND OF THE INVENTION

Typically a ceramic or glass lined hot water tank includes a cylindrical side wall with a cylindrical top having a concave interior surface to define a "plus" head for the tank. The bottom of the tank has a convex interior surface to define a "minus" bottom for the tank. This arrangement has been manufactured for a considerable number of years where the technique is normally to weld the top to the cylindrical side wall rolled from a flat rectangular blank and to coat the interior of the bottom open ended tank. A precoated bottom having the convex interior surface is then welded to the base of the tank.

Although such construction is acceptable for hot water tanks, it has been found that tank failure is a problem in the industry normally due to the hot water at the top of the tank which increases the corrosion at the joint between the tank top and the side wall. Such failure is normally caused by interruption in the glazing or coating applied to this area during the coating process. An additional drawback of this construction is that the "minus" bottom for the tank requires a material thickness considerably thicker than the side wall of the tank to ensure that under pressure the tank bottom, at least in its central area, does not flex which could crack or in one way or another disrupt the coating. An additional drawback with the "minus" head construction is that it subtracts considerably from the assembled tank volume, hence the overall height of the hot water tank must be greater. The hot water at the top of the tank increases any corrosive reaction because released gases, which includes oxygen, are free to chemically react with and corrode any bare metal exposed by poor glazing or coatings. It is also appreciated that the speed of chemical reaction doubles with every 10° C. increase in temperature. In addition the abutting nature of the fit of the tank top with the tank side is not necessarily perfect because of nicks or other imperfections in the outer periphery of the cylindrical portion of the tank side wall and the top. Hence it is quite possible, even with the greatest of care in applying the glazing material that some uncoated areas exist at the joint between the tank top and the tank side wall.

To increase the tank volume, it would be beneficial to provide not only a "plus" head portion for the hot water tank but also a "plus" bottom portion. This would increase capacity of the tank for a given diameter with possible reduction in tank height depending on the shape of the "plus" head. However with the existing technology, there is no known approach to connect the "plus" bottom to the tank after the tank with welded "plus" top has been coated with ceramic material. If a "plus" bottom end for the tank as precoated were welded to the tank side wall in the manner in which the top is welded, the coating would be severely degraded or damaged due to the heat of welding. Such degradation would result in uncoated portions of steel which would be corroded by the hot water.

Considering prior art tank constructions which provide "plus" heads and bottoms for cylindrical tank construction, U.S. Pat. No. 3,199,711 discloses a fire extinguishing tank which may contain pressurized materials. The tank is constructed of materials which are not corroded by the contents hence no protective or corrosion inhibiting coating is applied to the tank interior. For example in containing fire extinguishing liquids, the tank may be formed of copper or the like where the components are soldered together. A similar system is provided in U.S. Pat. No. 3,952,904 wherein again the material of construction is not corroded by its contents. The plastic bottom of concave interior shape is sonic welded to the plastic side walls of the barrier where a seal is provided at the connection to prevent leakage. No protective coating is required in the system nor is any welding used in making the connection where the heat of the weld could in any way affect an interior protective coating.

Other types of containers having "plus" end portions on cylindrical tank side walls are disclosed in U.S. Pat. Nos. 3,098,577 and 3,132,618. Neither patent contemplates interior coating of the tank surfaces to inhibit corrosion caused by its contents. The considerations given above to the prior form of hot water tank construction is not solved by the tank construction disclosed in these patents.

SUMMARY OF THE INVENTION

According to an aspect of the invention, a tank for containing a corrosive medium has a corrosion inhibiting coating on interior surfaces thereof. The tank comprises a cylindrical steel side wall and first and second ends for securement to and closure of the tank. At least the first end is concave-shaped and projects outwardly of the tank interior. At least the first end is secured to the tank by a connecting means having an annular body portion for controlling effect of welding heat on the corrosion inhibiting coating as previously applied to the tank side wall interior surface and the first end interior surface. A first portion of the annular body portion is connected at a first connection peripherally of the first end. A second portion of the annular body portion is connected at a second connection to a cylindrical end portion of the side wall. One of the first and second portions and corresponding first or second connection is coated with the corrosion inhibiting coating. The other of the first and second portions is a welded connection. The annular body portion controls temperature to which the coating is heated by spacing the welded connection a predetermined extent from the corrosion inhibiting coating.

According to another aspect of the invention, a process is provided for connecting a steel end to a corresponding end portion of a steel tank for containing a corrosive medium. The tank has a cylindrical side wall with an interior surface, the end being circular and having a concave shape extending outwardly of tank interior and connecting means for connecting the end to the tank side wall end portions. The process comprises connecting the connecting means to either of the end or the tank side wall. The interior surface of the tank, interior concave surface of the end and an exposed portion of the connecting means are coated with a corrosion inhibiting coating. The connecting means is welded to the end or the tank side wall. To complete connection of the end to the tank side wall, the coated exposed portion of the connecting means abuts the coating on the end interior surface of the tank side wall interior surface to form a coating juncture. Temperature to which the coating juncture is heated is controlled by predetermining an extent to which the connecting means spaces the welding of the connecting means from the coating juncture.

BRIEF DESCRIPTION OF THE DRAWINGS

Preferred embodiments of the invention are shown in the drawings wherein:

FIG. 1 is a perspective view of a hot water tank characteristic of the prior art devices;

FIG. 2 is a section through the bottom and top end portions of a tank of FIG. 1;

FIG. 3 is a section through the hot water tank bottom incorporating the method of connection of the "plus" bottom to the tank in accordance with an embodiment of this invention;

DETAILED DESCRIPTION OF THE PREFERRED EMBODIMENTS

Figure 6:
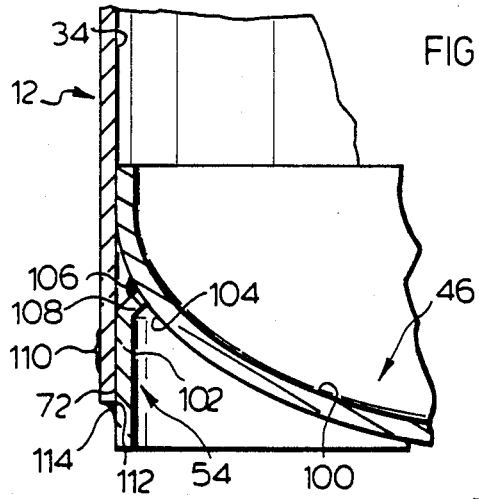
FIGS. 4 through 9 illustrate different embodiments of the invention for connecting the "plus" bottom of the hot water tank to the side wall of the tank in accordance with this invention.

This invention is applicable to many forms of tank construction which contain mediums corrosive to the tank material; for example, steel tanks for containing water, gas cylinders for acidic gases, fire extinguishers and beer kegs. The preferred embodiments of this invention will be demonstrated in a hot water steel tank construction. However, it is appreciated that such embodiments are equally applicable in other tank constructions.

Hot water tanks are used in residential and commercial establishments to heat and store water, normally at temperatures in the range of 120° F. to 160° F., where the source of heat is normally by electrical heating elements or gas fired heating devices. A typical tank used in electrical type of water heater is shown in FIGS. 1 and 2. The tank 10 consists of a cylindrical side wall 12 with a first or bottom end 14 and a second or top end 16. The ends of the tank are welded to the cylindrical side wall to seal the tank and provide a compartment in which water is heated and stored as hot water. It is understood that the water inlet and apertures for electrical heating elements, as provided in the side wall 12, are not shown. Usually the hot water is taken from the top of the hot water heater via the outlet 18.

The assembly of the hot water heater of the prior art device is normally accomplished by welding the end 16 to the side wall 12. With reference to FIG. 2, the top end 16 has a peripheral end portion 20 which is fitted within the side wall upper end portion 22. The top end 16 is welded to the side wall end portion 22 by a fillet weld 24 which connects the upper edge 26 to the outer side wall 28 of the end 16. A bottom open-ended tank is therefore provided where the tank interior with the end 16 in place is coated with a corrosion inhibiting coating. This may be accomplished by cleaning the inside of the tank and end by use of abrasives or acid pickling process to remove the oxides and dirt from the steel interior surfaces and at the same time etch the surface to provide for satisfactory bond of the corrosion inhibiting coating to the interior of the tank. After cleaning, the tank interior is coated with a glazing slurry which is commonly used in the art and consists of finely ground essentially ceramic powder suspended in water. The coating is applied to all internal surfaces including the interior concave surface 30 of the end 16 and also about the joint area 32 interior of the tank along with the tank side wall interior surface 34. To facilitate welding of the bottom end 14 to the tank side wall, the coating is wiped off the bottom edge 36 as well as a marginal interior portion of the tank side wall. The coated tank is then passed through a drier to remove water from the glazing slurry, and placed into a glazing furnace which operates normally at a temperature of about 1600° F. This results in a smooth corrosion resistant coating on the tank interior.

The bottom end 14 which has a convex interior surface is cleaned and glazed in a similar manner to the tank shell assembly. The glazing coating is wiped off in area 38 so as to be adjacent the cleaned end portion 36 of the side wall. The bottom 14 is inserted within the tank. The coating on the interior surface 40 of the tank bottom abuts the coating on the interior surface 34 of the side wall. A weld 42 is applied between surfaces 36 and 38. Usually the weld 42 is sufficiently remote from the area generally designated 44, which is the juncture of the coatings on interior surfaces 34 and 40, that the heat from the welding process does not degrade the coatings. Normally such welding is carried out by a type of submerged-arc process.

This type of tank construction has been used for many years in providing a "plus" head on the top of the tank and a "minus" head on the bottom of the tank. The "minus" head considerably reduces the volume for the tank considering its overall height. The bottom portion with the convex interior surface must be formed of material which is thicker than the side wall to withstand the pressures within the hot water tank. If the boIttom were made of thinner material the bottom could flex resulting in cracking of the coating and opening areas to corrosion causing tank failure. The material thickness for the bottom is usually in the range of 1.6 times thicker than the material thickness for the "plus" head portion providing the dished shapes are similar, which in turn is usually thicker than the material thickness for the side wall. This results in considerable inventory problems and the need to carry at least three different thicknesses of material depending on the parts made. An additional requirement is the extra tooling and machine set ups in manufacturing the parts.

To increase volume of the tank for its diameter and to permit use of thinner material thicknesses at least on the bottom of the tank, the provision of "plus" end at the bottom of the tank is a desired embodiment of the invention. However, after assembly of the tank side walls to the tank top and coating and subsequent welding of the tank "plus" bottom to the tank side wall, the welding would be on the tank bottom portion in a area which is coated. The heat from the weld would travel directly through the tank bottom wall portion thereby degrading the ceramic coating. This even becomes more of a problem if non-ceramic coatings are used such as polymeric coatings which include various suitable polyamides; for example Nylon II (trademark). Such degradation of the coating can result in its destruction and loss of corrosion inhibiting properties.

As already noted, another problem with existing tank construction is that several of the tank failures are due to a breakdown in the coating of the top seam area of the tank top to the side wall. Hence a construction which would avoid such breakdown is desired for the top construction of the hot water tank.

According to this invention a connection is provided for either end of the tank cylindrical side wall which can constitute either the top or bottom of the tank when in use. As shown in FIG. 3, the cylindrical tank side wall 12 has fitted to its bottom end portion 36 a "plus" bottom end 46. The end 46 has a concave interior surface 48 which extends outwardly of the interior of the tank. According to this embodiment the concave interior surface 48 has a semi-ellipsoidal shape. However, it is appreciated that the end may be torispherical in shape as defined in ASME Boiler and Pressure Vessel Code, Section VIII, Division 1, 1977 Edition. Due to essentially constant material thickness the exterior surface 52 of the end 46 approximates the same shape. To provide for connection of the end 46 to the interior of the side wall 12, a connecting device generally designated 54 having an annular boby portion is used. According to one aspect of the invention, the connecting device 54 is secured to the peripheral edge portion 56 of the exterior of the end 46. Such connection may be by welding or other suitable securing means.

Prior to assembly of the end 46 to the cylindrical side wall 12 of the tank, the interior surface 34 of the tank is coated as well as the interior surface 48 and the exterior portion of the connecting means 54. Any excess applied coating in region 57, which is to be subsequently welded to the tank wall is wiped off. The tank interior end is also wiped off to leave opposing uncoated surfaces for welding. The end portion 46 is then inserted into the end 36 of the cylindrical side wall where the coatings on the connecting means 54 and on the interior surface 34 of the tank overlap and contact one another to seal the tank end. The connecting means is then welded to the end 36 by a fillet weld 58. The connecting device 54 is arranged to control the temperature to which the juncture of the overlapped coatings is heated by the process of welding the connecting means to the end 36. Such control on temperature is exercised by predetermining the extent to which the connecting device 54 spaces the fillet weld 58 from the juncture of the overlapped coating and also from the coating on the interior surface of the end and tank side wall. The connecting device 54 conducts heat from the welding region of weld 58 towards the juncture of the coatings. By trial and error, the extent to which the connecting device spaces the weld from the juncture of the coatings can provide a control on the temperature to which the coatings are heated. It may be desired to control the temperature to an extent which minimizes or avoids any effect of welding heat on the coatings at the juncture. Alternatively, it may be desirable to control temperature to the extent that the coatings at least at the juncture are fused during the welding process. It is appreciated that, when it is desired to increase the temperature at the coating juncture, a shorter height for the connecting device is provided, or the mass of the connecting device is reduced, or is made from material which conducts heat at a faster rate to the juncture area. Further detail of the overlap of and formation of a juncture of the coatings and the welding technique will be discussed with respect to the various embodiments of the invention as shown in FIGS. 4 through 9.

To complete the assembly of the bottom of the hot water tank a cylindrical base or stand 60 is provided. The stand 60 has a inwardly stepped portion 62 which is secured to the interior surface 64 of the connecting device. The stand has a peripheral bottom edge 66 which extends below the lowermost portion 68 of the end 46 to act as the support feet for the hot water tank when it is stood upright for use.

Figure 4:
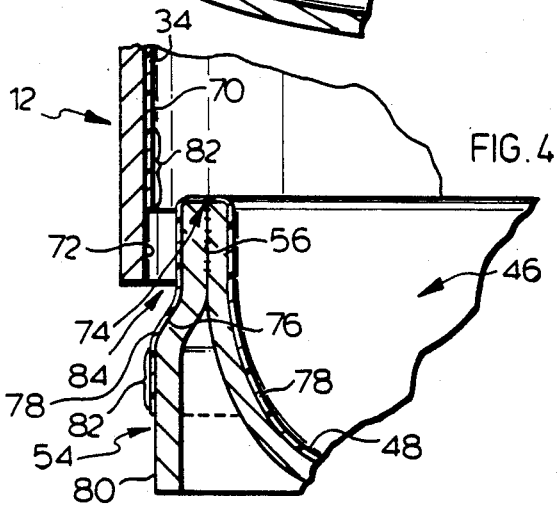

The coating for the connecting device 54 for the end 46 and also for the interior 34 of the tank side wall 12 is shown in more detail in FIG. 4. The connecting device 54 comprises an annular skirt portion having exterior surface 76 which is welded at 74 to the exterior surface 56 of the end portion. The skirt extends outwardly of the end portion and is stepped in area 84 to facilitate insertion of the end 46 into the tank. The coating 70 as applied to the interior surface 34 may be of a fired ceramic composition or of some polymeric composition, such as "Nylon". As already discussed in providing a ceramic or glass lined coating, a slurry including ceramic particles is coated onto the interior surface 34 of the tank side wall. The lower circumferential end portion of the shell interior 72 does not include coating material hence this area is left uncoated after the tank side wall has been dried and fired. The end 46 and the connecting device 54 also have the slurried ceramic coating applied thereto over the entire interior surface 48 of the end, and overlapping the welded area 74 which includes the connection of the connecting device 54 to the external edge portion 56 of the end. The exterior surface 76 of the connecting device is also coated with the slurried material to provide thereby an essentially continuous coating 78. The lower portion 80 is left uncoated to provide an uncoated peripheral area 80 about the perimeter of the connecting device 54.

The coatings, which have been applied to the tank side wall interior surface and to the end 46, are then glazed, cured or fused. The end is then inserted into the tank end until the coated surfaces 70 and 78 contact in the region designated 82 on the connecting device exterior surface 76 and also on the lower portion of the coating 70 of the tank side wall. Such contacting of the coatings forms a seal about the periphery of the tank bottom end to prevent water leakage and thereby form effectively a continuous coating from the side wall onto the end 46. In providing parallel coated surfaces which form the juncture of coatings, a significant circumferential band of contact area is provided for the contacting coatings. Such band area of contact ensures a seal about the peripheral juncture of coatings, because of the band height over which contact between the coatings can be established. If there is difficulty in providing a seal about the peripheral juncture of the coatings, as discussed, it is possible by way of the connecting device to control the temperature to which the juncture of coatings is heated to fuse coatings in that area without totally degrading the coatings and losing any potential for a seal at this juncture. This is particularly applicable when the coatings are of a polymeric material, such as "Nylon" which can be fused when heated to the proper temperatures. It is appreciated that a sealant, such as an epoxy coating or gasket, may be applied to the juncture before welding. The heat of welding is then controlled by the connecting device to ensure that the epoxy sealant or gasket is not degraded.

The end portion is now in a position to be secured to the tank side wall 12. The connecting device 54 extends a sufficient distance outwardly of the juncture 82 of the coatings such that when the uncoated portion 80 is welded to the uncoated portion 72 of the tank side wall, the heat of the welding does not in any way degrade the non-corrosive characteristic of the coatings at least in the area of juncture 82 and inwardly thereof. Such connecting device 54 serves to space the welded area away from the coating not only on the connecting device 54 but also on the interior surface of the end 46 such that when the weld is completed a continuous coating remains on the bottom surface and side wall area of the tank. The welding which may be used to connect the connecting device 54 to the outer peripheral edge portion 56 of the end is done before the coating is applied to the end and connecting device hence the heat of the weld of that connection has no effect on the subsequent coating process. In actual fact, the coating overlaps the seamed area and any weld which may be present to coat and protect that area from corrosion by the contained liquid which is normally water.

It is appreciated that the principle of the invention may be accomplished in a variety of configurations for connecting an end portion to the tank side wall. With reference to FIGS. 5 through 9 such alternative arrangements are shown where it is understood that the surfaces as exposed to the contained liquid are coated with the corrosion inhibiting materials.

Figure 5:
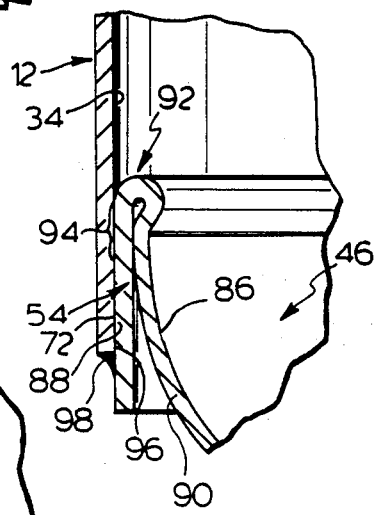

As shown in FIG. 5, the end 46 has a concave interior surface 86 which may be of the ellipsoidal, torispherical or hemispherical configuration as shown in FIG. 3. The connecting device 54 includes the annular skirt portion 88 which extends outwardly of the interior of the tank. According to this embodiment the skirt portion 88 is a continuation of the wall portion 90 of the end as provided for by a reverse bend 92. The end 46 as fabricated from an essentially constant material thickness of steel is coated prior to insertion within the tank side wall 12 which has a coating on its interior surface 34. The coatings are such to form a juncture in the region 94 which effectively forms a seal about the bottom of the tank. Uncoated portions of the tank side wall in region 72 and 96 of the skirt exterior are provided so that a fillet weld 98 may be used to connect the end 46 to the tank side wall 12. The skirt of the connecting device 54 extends outwardly of the tank interior a sufficient distance so as to locate the fillet weld 98 at a region where the heat of the weld does not degrade the non-corrosive properties of the coating at least in the area of juncture 94 about the perimeter of the connecting device 54. By providing this reverse bend arrangement 92 for the end 46, the entire end portion may be fabricated from a single blank of steel sheet material without requiring any welding operation in the reverse bend region 92.

With reference to FIG. 6, another embodiment is shown for the end 46 of the hot water tank for installation and connection to the tank side wall 12. With this type of assembly, the top and bottom ends can be of the same diameter. This approach considerably reduces inventory costs in keeping separate tank ends for completing the tank construction. The end 46 has a concave interior surface 100. The connecting device 54 comprises a skirt portion 102 having its upper end which is angled towards the bottom portion 104 of the end 46. A fillet weld at 106 connects the angle portion 108 of the skirt to the end 46. The assembly of the connector device 54 and the end 46 are coated in the manner similarly used in coating the other embodiments. The interior surface 34 of the side wall is coated, such that when the end 46 is inserted within the tank side wall the coatings contact and form a seal in the juncture region 110. With the end portion assembled within the tank the uncoated portions of the tank end 72 and the connector skirt portion 112 are connected by fillet weld 114, the heat of which does not affect the coatings in the region 110.

Figure 7:
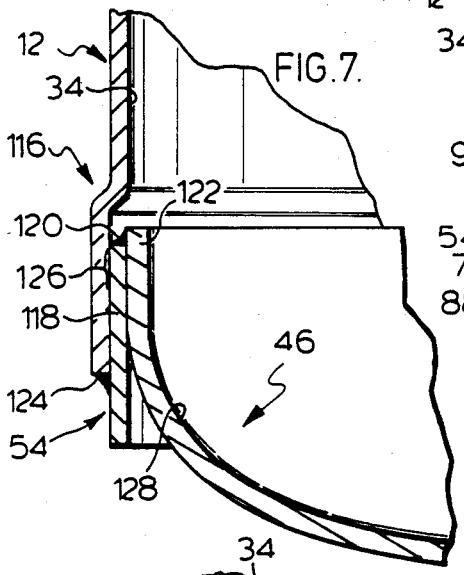

The embodiment of FIG. 7 is an alternative to that of FIG. 6, where an arrangement is provided which permits the use of an end 46 which is the same as the other end used in connecting to the top portion of the tank side wall in accordance with the technique shown in FIG. 2. To accommodate the thickness of the connecting device 54 the side wall 12 is stepped in region 116. According to this embodiment the connecting device 54 is a skirt portion 118 which is welded at 120 to the peripheral edge portion 122 of the end 46. The end 46 with the connecting device 54 is coated independently of the side wall interior surface 34. In coating the end portion 46 the coating covers the seam area which includes the weld 120. After the end 46 is inserted in the tank end portion, the end is secured by way of a weld 124. The skirt 118 extends sufficiently outwardly of the tank so as to locate the weld 124 a sufficient distance from the region 126 about which the coatings on the interior surface 34 of the tank and on the connecting device 118 contact one another. The heat of weld from welding 124 does not degrade coatings in this area or interior thereof including the coating on the interior 128 of the end 46.

Figure 8:
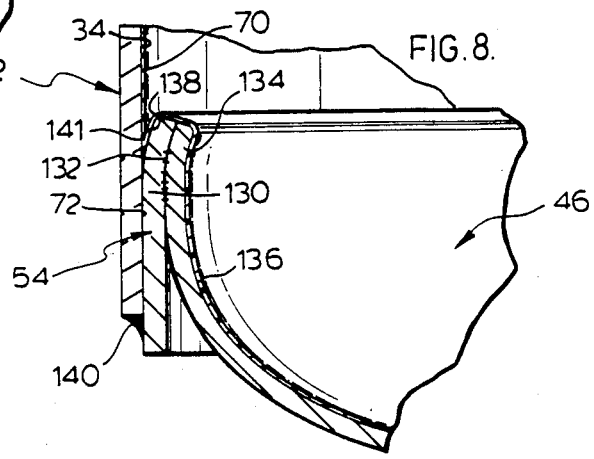

Another arrangement is provided in FIG. 8 for connecting the end portion 46 to the tank side wall. The connecting device 54 includes a skirt portion 130 which is welded at seam 132 to the peripheral edge 134 of the end 46. The welded assembly is then curved inwardly to the extent shown in FIG. 8 to provide for a lead in portion in inserting the end 46 within the tank side wall 12. The tank side wall 12 is provided with the coating 70 in the manner discussed with respect to FIG. 4, the tank end 46 with connecting device 54 is coated with a coating 136 which extends over the seam area 132 and downwardly of the outer wall portion 138 of the skirt 130. A fairly close tolerance fit is provided between the uncoated portion of the outer surface 138 of the skirt 130 and the corresponding uncoated portion 72 of the tank side wall. The weld 140 is located a sufficient distance from the juncture 141 of the coating so as to not degrade same. Similarly the skirt 130 spaces the weld 140 from the coating 136 on the interior of the end 46.

Figure 9:
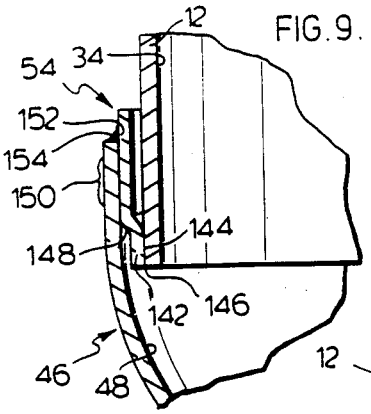

It is also possible to provide for the connection of the tank side wall to a "plus" end, bottom or top which has an internal diameter at its circumferential portion greater than the external diameter of the tank shell. This type of connection is shown in FIG. 9, wherein the tank side wall 12 has the connecting device 54 secured at a first portion 142 to the exterior 144 of the tank side wall. The inner surface 34 of the tank is coated with the corrosion inhibiting coating including the connection area 146 and remaining exposed external surface 148 of the connecting device 54. The "plus" end, which may be the bottom 46, has a coating on its interior surface 48 which overlaps the coating on surface 148 of the connecting device in the region 150. The second portion 152 of the connecting device is fillet welded at 154 to the end 46 to complete the assembly of the end to the tank side wall. The connecting device 54 spaces the fillet weld 154 a sufficient distance from the overlapped region 150 to control the temperature to which the overlapped region of coatings is heated during the welding operation. By this technique, a larger end can be assembled to a smaller tank shell.

Figure 10:
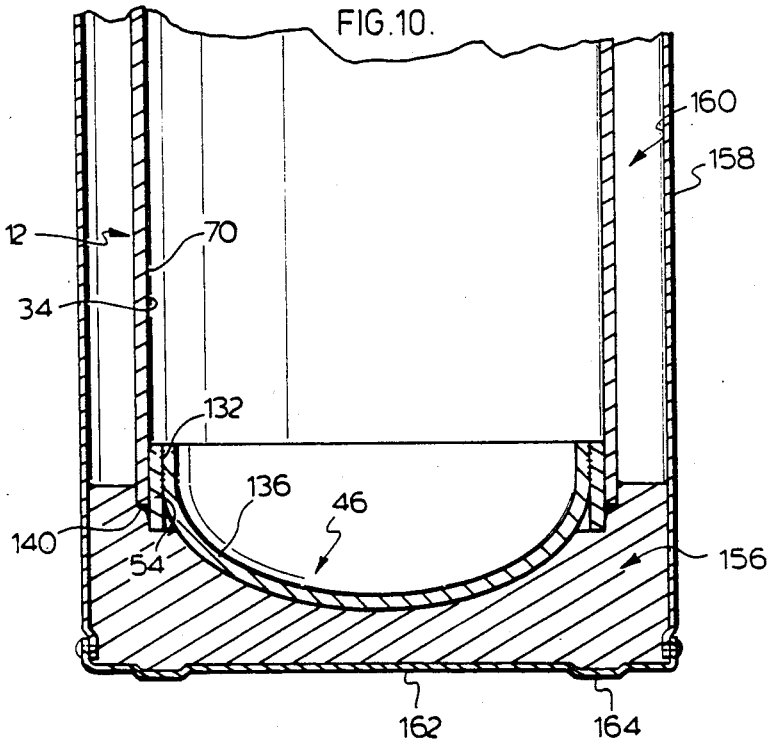
FIG. 10 is a section through the hot water tank base showing an alternative arrangement for supporting the hot water tank with a "plus" bottom.

An alternative stand assembly for the hot water tank is provided in FIG. 10. The end 46 is assembled to the tank side wall 12 in accordance with the structure generally shown in FIG. 8. For hot water tanks which are insulated with a foaming material such as urethane foam a prefabricated foamed base 156 is provided which receives the shape of the end 46. With the tank bottom on the foam base 156 a shell assembly 158 may be assembled around the base and the tank leaving a cavity 160 between the tank exterior 158 and the tank side wall 12 and also about the top portion (not shown). With the assembly complete, a foam material is introduced into the cavity 160 to fill the cavity with an insulating foam material and solidify the structure once the foam urethane composition has set. This provides for a quick assembly technique for the hot water tank construction where the shell 158 including a platform 162 is now complete and ready for use where the platform includes projecting feet portions 164.

As previously discussed with respect to FIG. 2, the prior art technique of assembling the top to the tank end has resulted in failures. This can be avoided in tanks having a "minus" bottom by using the same technique for assembling the "plus" bottom end of the tank, as discussed with respect to FIGS. 3 through 10, to similarly assemble the "plus" top to the tank end. It is appreciated that in connecting a top end to the tank a skirt extension or the like 60 as shown with respect to FIG. 3 is not required. In the case of foam insulating the tank the tank upper portion may be the mirror image of that shown in FIG. 10 without the use of feet or the like where appropriate openings and piping arrangement are provided for the outlet of the hot water tank.

By this method of assembly in isolating the welding for connecting a tank end to the tank side wall so that the tank coatings are not degraded, one can provide "plus" head configurations at each end of the tank to increase the tank volume and in addition permit the use of thinner material thicknesses for the tank ends since the concave shape for the tank end can accommodate considerably greater stresses without yielding. By considerably reducing the material thickness of the end portions which may be equal to or less than the thickness of the tank side wall, appreciable savings in tank construction are achieved. For example, with a tank construction where the top is also used as the bottom and assembled in the manner shown with respect to FIG. 7, there is a material saving of approximately 8%. With a tank end configuration having ends approximating the ellipsoidal configuration of FIG. 3 or a similar torispherical shape, there can be a material saving of approximately 20%. When the tank ends approach a hemispherical shape the material saving can be approximately 31%. This is accomplished by the fact that as the tank ends approach a hemispherical shape considerably thinner material thickness for the tank ends may be used while still accommodating the tank pressures.

The relationship of the material thickness of the tank end compared to the thickness of the tank side wall for resisting stresses created by pressures within the tank are well understood in pressure tank design. This permits the use of thinner materials in the tank ends to considerably reduce the amount of material used in manufacturing the tanks knowing that the tank end can be designed to accommodate a predetermined stress. Surprisingly with the prior art construction of FIG. 2 even with the "plus" head configuration for the tank top, the material thicknesses for the tank top is usually 1.6 times the tank side thickness and for the bottom "minus" head the thickness usually averages more than 1.9 times the tank side wall thickness. In accordance with this invention where the "plus" head arrangement is used at both the tank top and bottom, it has been found that both ends may be of a thickness less than the tank side wall thickness. This results in significant material savings, to upwards of 28%, and considerably reduces failures of the tank in the region of the joint of tank top to side wall. In addition the design provides for a significant glazing energy saving which can be realized in the range of 10 to 30% depending upon the shape for the tank ends. Another form of energy saving can be realized due to the overall reduction in tank surface area for the volume of water contained. Due to the reduced tank surface area, there is less heat loss so that less energy is required to maintain the water at the desired temperature.

The method, according to this invention, is conducted in the manner described where the significant advantage with one of the embodiments of the invention is that the tank side wall may be coated independently of the end portions. Hence the interior of the side wall can be inspected for flaws before the ends are connected to the tank side wall. In addition, the threads of the outlet 18 can be independently inspected. This is particularly important when coatings of ceramic slurry are applied to the tank interior. In addition, with coating the tank ends with ceramic slurry the effectiveness of the coating can be inspected particularly about the seaming area of the connecting device.

Although preferred embodiments of the invention have been described herein in detail it will be understood by those skilled in the art that variations may be made thereto without departing from the spirit of the invention or the scope of the appended claims.

The embodiments of the invention in which an exclusive property or privilege is claimed are defined as follows:

1. In a pressurized steel tank for containing a corrosive medium having a corrosion inhibiting coating on interior surfaces of said tank, said tank comprising a cylindrical steel side wall and first and second ends for securement to and closure of said tank, at least said first end being concave shaped and projecting outwardly of tank interior, said first end being secured to said tank by a connecting means having an annular body portion for controlling effect of welding heat on said corrosion inhibiting coating as previously applied to said tank side wall interior surface and said first end interior surface, a first portion of said annular body portion being connected at a first connection peripherally of said first end and a second portion of said annular body portion being connected at a second connection to a cylindrical end portion of said side wall, one of said first and second portions and corresponding first or second connection being coated with said corrosion inhibiting coating, the other of said first and second portions being a welded connection, said annular body portion controlling temperature to which said coating is heated by spacing said welded connection a predetermined extent from said corrosion inhibiting coating.

2. In a tank of claim 1, said second connection being coated with said second portion of said annular body portion being connected to an exterior surface of said side wall cylindrical end portion, said first portion of said annular body portion being welded to a circular interior surface of said first end, said annular body portion being coated with said coating to circumferentially abut said coating on said first end interior surface.

3. In a tank of claim 2, said annular body portion controlling temperature of said abutting coatings during welding of said first connection to fuse said abutting coatings.

4. In a tank of claim 1, said annular body portion extending outwardly of said first end and being coated with said coating which has been applied to said interior surfaces of said first end, said annular body portion being slidably received by an interior cylindrical end portion of said side wall, said coating on said side wall interior surface circumferentially abutting said coating on said annular body portion to provide a seal at a juncture of said side wall interior coating and said annular body portion coating, said side wall interior surface and adjacent said portion of said annular body portion being uncoated outwardly of said juncture of coatings, a weld connecting said uncoated side wall and annular body portion together.

5. In a tank of claim 4, said second end being concave-shaped and projecting outwardly of tank interior and being welded to said side wall to provide a peripheral interior junction of said second end to a second end wall of said side wall, said coating extending over said interior junction.

6. In a tank of claim 4, said first end having an essentially uniform thickness less than or equal to an essentially uniform thickness for said side wall.

7. In a tank of claim 4, said annular body portion being integral with said first end and being an extension of said end in a reverse direction as provided for by a reverse bend in said first end around its periphery, said reverse bend constituting said first connection.

8. In a tank of claim 4, said annular body portion being a circular shaped skirt surrounding a peripheral edge of said first end, said skirt having an inner circular edge proximate said peripheral edge of said first end and an outer circular edge extending outwardly beyond said first end portion of said side wall.

9. In a tank of claim 8, said skirt inner edge being welded to said first end peripheral edge prior to said interior surface of said first end and said skirt being coated with said coating, said coating as applied to said skirt terminating at a location spaced inwardly of said skirt outer circular edge, said uncoated interior surface of said side wall being adjacent said uncoated portion of said skirt with said skirt outer surface welded to said side wall.

10. In a tank of claim 8, said skirt extends outwardly beyond said first end, said skirt outer edge functioning as a floor support for said hot water tank when in an upright position.

11. In a tank of claim 8, 9 or 10, said first end having an essentially uniform thickness less than or equal to an essentially uniform thickness for said side wall.

12. In a tank of claim 4, said second end being concave-shaped and projecting outwardly of tank interior and being secured to said tank by a second connecting means which functions in a manner for connecting said second end to said tank the same as said connecting means for said first end.

13. In a tank of claim 12, said second connecting means being a circular shaped skirt surrounding a peripheral edge of said second end, said skirt having an inner circular edge proximate said peripheral edge of said second end and an outer circular edge extending outwardly beyond a second end portion of said side wall.

14. In a tank of claim 13, said inner edge being welded to said second end peripheral edge prior to said interior surface of said second end and said skirt being coated with said coating, said coating as applied to said skirt terminating at a location spaced inwardly of said skirt outer circular edge, said uncoated interior surface of said side wall being adjacent said uncoated portion of said skirt with said skirt outer surface welded to said side wall.

15. In a tank of claim 4, 9 or 13, said first and second ends having an ellipsoidal, torispherical or hemispherical shape in cross-section along a diameter of either of said first or second ends.

16. A process for connecting a steel end to a corresponding end portion of a steel tank for containing a corrosive medium, said tank having a cylindrical side wall with an interior surface, said end being circular and having a concave shape extending outwardly of tank interior, connecting means for connecting said end to said tank side wall end portion, said process comprising connecting said connecting means to either of said end or said tank side wall, coating said interior surface of said tank, interior concave surface of said end and an exposed portion of said connecting means with a corrosion inhibiting coating, welding said connecting means to said end or said tank side wall to complete connection of said end to said tank side wall, said coated exposed portion of said connecting means abutting coating on said end interior surface or said tank side wall interior surface to form a coating juncture, controlling temperature to which said coating juncture is heated by predetermining an extent to which said connecting means spaces said welding of said connecting means from said coating juncture.

17. A process of claim 16, wherein said temperature of said coating juncture is controlled to fuse said abutting coating at said juncture.

18. A process of claim 16, wherein said connecting means is connected peripherally of and extends outwardly of said end, a circumferential portion of said tank interior surface adjacent said end portion and a peripheral portion of said connecting means being left uncoated when said interior surface of said end and said connecting means are coated, inserting said end within said side wall end portion to contact said coatings on said side wall interior surface and on said connecting means to form a juncture of side wall coating with connecting means coating which seals said tank end, and welding said uncoated portions of said side wall and said connecting means.

19. A process of claim 18 wherein said coating is applied in the form of a ceramic slurry to said interior surface of said tank and to said interior surface of said end and its connecting means, said end portion of said tank is wiped clean of said slurry to leave said uncoated circumferential portion and said connecting means is also wiped clean about said peripheral portion to leave said corresponding uncoated portion, said tank side wall interior and said end are subjected to drying and glazing temperatures to provide a glazed ceramic coating which is corrosion inhibiting.

20. A process of claim 18 wherein both ends of said tank are secured by use of said connecting means to provide a tank having both ends which have concave interior surfaces.

21. A process of claim 20 wherein said concave shaped ends used in sealing said tank have a material thickness equal to or less than the material thickness of said tank side wall.

* * * * *